US005954328A

United States Patent [19]

Hatanaka

[11] Patent Number: 5,954,328

[45] Date of Patent: Sep. 21, 1999

[54] PAPER FEED MECHANISM

[75] Inventor: Fumio Hatanaka, Osaka, Japan

[73] Assignee: Mita Industrial Co., Ltd., Osaka-fu, Japan

[21] Appl. No.: 08/889,175

[22] Filed: Jul. 7, 1997

[30] Foreign Application Priority Data

Jul. 9, 1996 [JP] Japan ..... 8-179647

[51] Int. Cl.[6] ..... B65H 3/06; B65H 3/52

[52] U.S. Cl. ..... 271/119; 271/122

[58] Field of Search ..... 271/119, 120, 271/121, 125, 122

[56] References Cited

U.S. PATENT DOCUMENTS 5,318,287 6/1994 Okayama ..... 271/119 X
5,372,359 12/1994 Miura et al. ..... 271/119

FOREIGN PATENT DOCUMENTS 37044 2/1988 Japan ..... 271/119
13530 1/1990 Japan ..... 271/122

*Primary Examiner*—Boris Milef
*Attorney, Agent, or Firm*—Jordan and Hamburg LLP

[57] ABSTRACT

Disclosed is a paper feed mechanism in which copy paper stacked on a paper support member such as a manual insertion tray is fed along the sheet transport direction in a nipped state between an upper roller and a lower roller. The upper roller has, on its outer surface in the described order with respect to the rotational direction, a non-contact area which is not brought into pressing contact with the copy paper and the lower roller, a first contact area which comes into pressing contact with the copy paper and the lower roller and whose frictional coefficient relative to copy paper is set small, and a second contact area which comes into pressing contact with the copy paper and the lower roller and whose frictional coefficient relative to copy paper is set large. The lower roller is mounted on a torque limiter. The lower roller is rotated in a direction opposite to the sheet transport direction via the torque limiter when not coming into pressing contact with the first and second contact areas of the upper roller, while rotated in the sheet transport direction following the rotation of the upper roller when coming into pressing contact with the first and second contact areas of the upper roller.

14 Claims, 7 Drawing Sheets

PAPER FEED MECHANISM

BACKGROUND OF THE INVENTION

This invention relates to a paper feed mechanism for use in an image forming apparatus such as a copying machine, a facsimile machine, and a printer.

Description of the Background Art

Conventionally, there has been known a paper feed mechanism of a type in which a cross sectional D-shaped roller having a contact area (round portion) for pressingly coming into contact with a copy paper and a non-contact area (flat portion) is employed to feed copy paper, stacked on paper support means such as a paper cassette, one by one into an image forming apparatus along in a sheet transport direction (Japanese Unexamined Patent Publication No. HEI 5-330682). The paper feed mechanism disclosed in this publication can prevent multifeed of copy paper by a pair of separation pawls which are provided on widthwise opposite ends of a lead portion of the paper support means.

Another type of paper feed mechanism is proposed in which a first roller, similar to the above D-shaped roller and a second roller disposed below the first roller, are used to feed copy paper in the sheet transport direction by nipping the copy paper between the first and second rollers while rotating the same in the forward direction (sheet transport direction). In this mechanism, multifeed of paper is prevented by mounting a torque limiter to the second roller.

The paper feed mechanism with the torque limiter functions as follows. When copy paper is not nipped between the first and second rollers, the second roller rotates in a reverse transport direction opposite to the sheet transport direction together using the torque limiter, thereby preventing the copy paper not in a nipped state from being inadvertently fed in the sheet transport direction. On the other hand, when copy paper is in be fed to the sheet transport direction in a nipped state between the first and second rollers, the second roller is rotated in the forward direction following the rotation of the first roller. In this way, multifeed of copy paper is prevented.

The above paper feed mechanism with the torque limiter has the following problem. In order to initiate the forward rotation of the second roller accompanied by the rotation of the first roller, the first roller and second roller are required to be already in a pressing contact state for nipping copy paper therebetween. This means that feed of copy paper is initiated when the motion of the second roller is still in an unstable state immediately after it is shifted from the reverse transport rotation to the forward transport rotation. That is, the feed of copy paper becomes unsteady, resulting in a failure to transport the copy paper toward rollers arranged downstream, such as transport roller pair, and registration roller pair as timed with the feed of copy paper from the paper support means.

SUMMARY OF THE INVENTION

In view of the above, it is an object of the invention to solve the above drawback residing in the prior art.

It is another object of the invention to provide a paper feed mechanism having a construction in which copy paper is fed in a nipped state between and first roller and a second roller in a sheet transport direction with the provision of a torque limiter to the second roller, which has the capability of stabilizing timing of transporting the copy paper downstream in the sheet transport direction.

To accomplish the above objects the present invention provides, a paper feed mechanism in which copy paper stacked on paper support means is fed therefrom in a sheet transport direction, the paper feed mechanism comprising: a first roller for feeding copy paper stacked on the paper support means therefrom in the sheet transport direction; a second roller for feeding the copy paper in the sheet transport direction by nipping the copy paper between the first roller and the second roller; a torque limiter connected to the second roller; and drive means for rotating the first roller in the sheet transport direction and for rotating the second roller in a direction opposite to the sheet transport direction via the torque limiter, the first roller including a non-contact area and a contact area following the non-contact area around an outer surface thereof, the contact area having a first contact area and a second contact area following the first contact area, the first contact area coming into pressing contact with the copy paper and the second roller and slipping over a surface of the copy paper, the second contact area coming into pressing contact with the copy paper and the second roller to feed the copy paper from the paper support means in the sheet transport direction by a frictional force exerted on the copy paper.

With this arrangement, when the first roller is rotated, the first contact area comes into contact with the copy paper first. However, since a friction force exerted between the first contact area and the copy paper is relatively small, the first contact area merely slips over the surface of the copy paper, and thus the copy paper is kept from being fed from the paper support means. Then, when the second contact area comes into pressing contact with the copy paper, the copy paper is fed out from the paper support means utilizing a friction force exerted between the copy paper and the second contact area.

Referring to the second roller, when the second roller comes into pressing contact with the first contact area of the first roller, the second roller which has been rotated in the direction opposite to the sheet transport direction i.e. in the same rotational direction as the first roller is enabled to follow the rotation of the first roller by an actuation of the torque limiter. At this stage, however, the copy paper is not fed to the nip position between the first and second rollers because the first contact area merely slips over the copy paper. Accordingly, it is assured that the copy paper is fed to the nip position only after a certain period lapses from reversing of the rotational direction of the second roller.

The above and other objects, features and advantages of the present invention will become more apparent upon a reading of the following detailed description and drawings.

DETAILED DESCRIPTION

Figure 1:
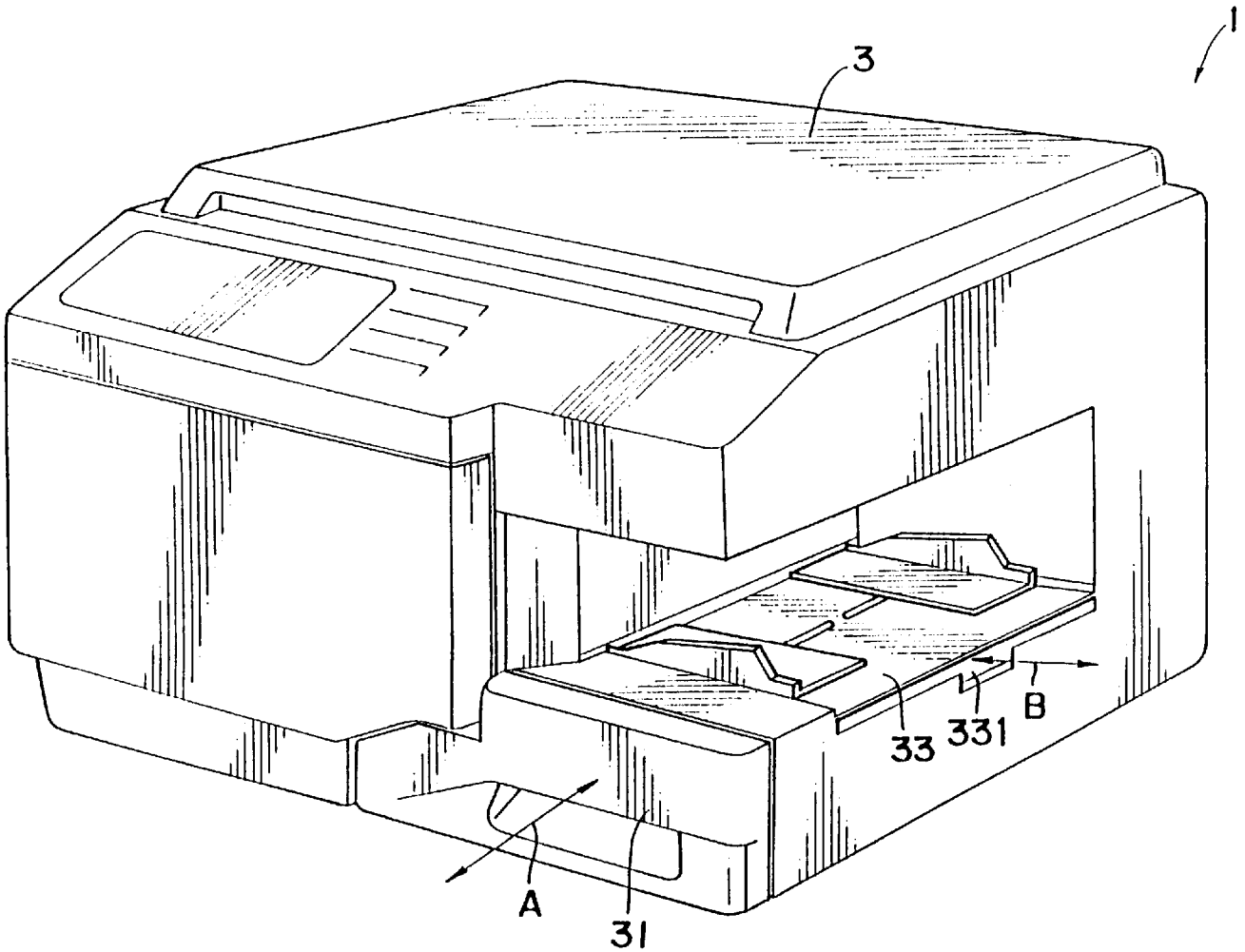
FIG. 1 is a perspective view showing an external appearance of a copying machine incorporated with a paper feed mechanism according to this invention.
Figure 2:
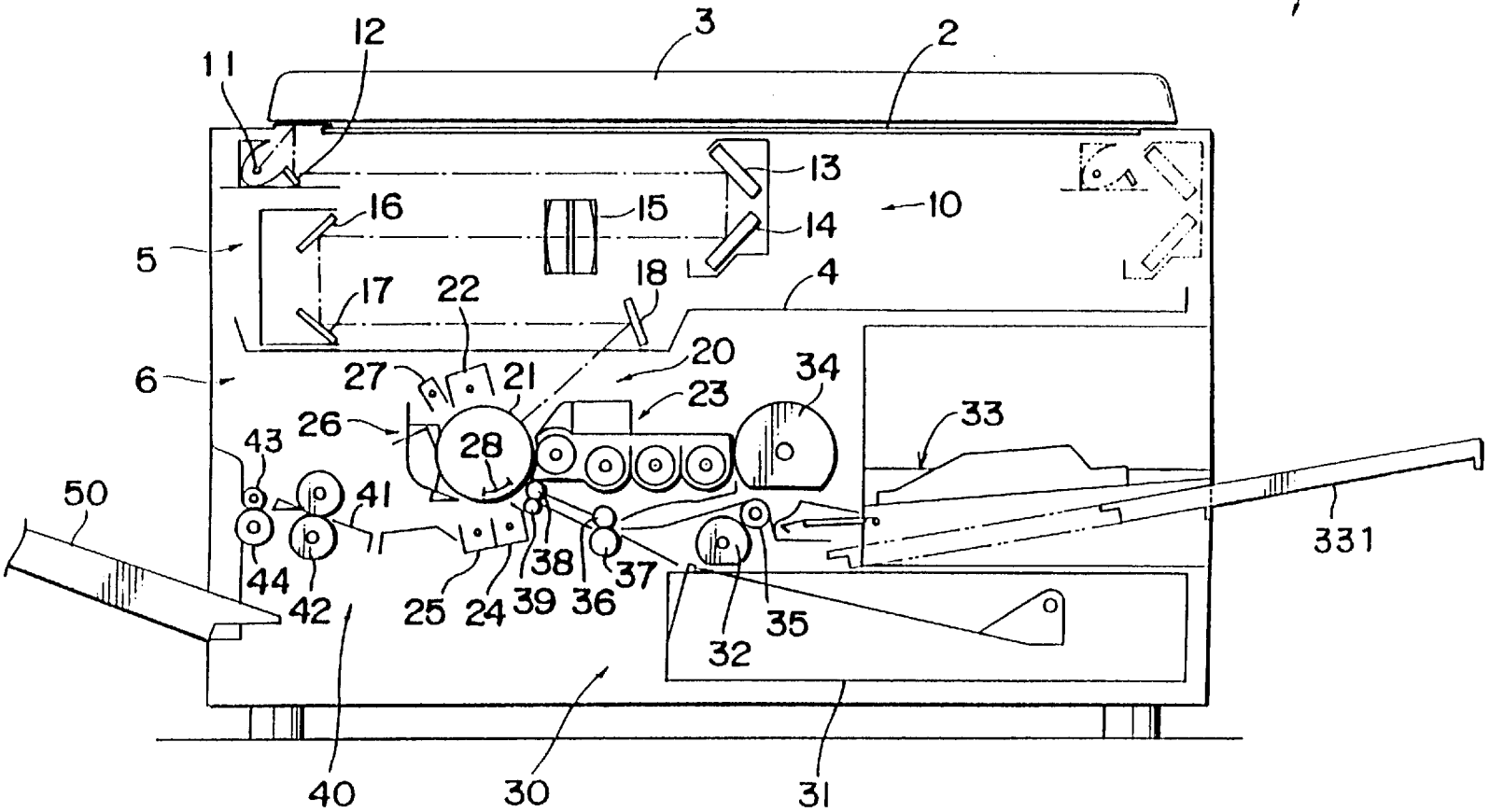
FIG. 2 is a diagram of an interior arrangement of the copying machine.

FIG. 1 is a perspective view showing an external appearance of an image forming apparatus (in this embodiment, a copying machine) incorporated with a paper feed mechanism embodying the invention, and FIG. 2 is a diagram showing an interior arrangement of the copying machine.

Numeral 1 denotes the copying machine. A contact glass 2 for placing an original thereon is fixedly mounted at a top of the copying machine 1. A document presser 3 is mounted openable with respect to the contact glass 2. When an original is placed on the contact glass 2, the document presser 3 is set to cover an entire plane of the contact glass 2 and a copy start key (not shown) is pressed, the copying machine 1 enters a copy enable state where an original image is copied on a copy paper by operations of constituent members arranged inside the copying machine 1. The various constituent members are described below.

As shown in FIG. 2, there is provided a partition plate 4 inside the copying machine 1. With the partition plate 4, the inside of the copying machine is separated into two parts, i.e., upper space 5 and lower space 6. An optical unit 10 is arranged in the upper space 5 while an imaging unit 20, a sheet transport unit 30, and a fixing unit 40 are arranged in the lower space 6.

The optical unit 10 includes an exposure lamp 11 functioning as an exposure light source. Light from the exposure lamp 11 illuminates a surface of the original placed on the contact glass 2 to form a light image of the original. The optical unit 10 comprises reflective mirrors 12 to 14 for guiding the light image reflected from the original surface to a specified position, a lens 15 for focusing the light image on a surface of a photosensitive drum 21, and reflective mirrors 16 to 18 through which the light image is guided toward the photosensitive drum 21. The exposure lamp 11 and the reflector 12 reciprocate integrally horizontally, while the reflective mirrors 13 and 14 integrally horizontally reciprocate in synchronism with the reciprocation of the exposure lamp 11 and the reflector 12, thereby conducting image scanning of the entire surface of the original.

The imaging unit 20 has the photosensitive drum 21 which is rotated in the clockwise direction on the plane in FIG. 2 at a constant speed by drive means (not shown). In the periphery of the photosensitive drum 21, there are arranged a main charger 22, developing portion 23, transfer portion 24, separator portion 25, cleaner 26, and a blank lamp 27 from an upstream side along the rotational direction of the drum in the described order.

After being charged uniformly by the main charger 22, the surface of the photosensitive drum 21 is exposed to the light image to form an electrostatic latent image thereon. The latent image is developed into a toner image by the developing portion 23 by electrostatically attracting toner. Then, the toner image is transferred onto a copy paper which is transported to a transfer region 28 of the photosensitive drum 21 by the transfer portion 27. The transfer region 28 opposes to the transfer portion 24. After being separated from the photosensitive drum 21 by the separator portion 25, the copy paper carrying the transferred toner image is guided to the fixing unit 40 to be described later.

Copy paper is transported to the above constructed imaging unit 20 by the sheet transport unit 30 in the following manner. The sheet transport unit 30 has a sheet cassette 31 detachably mounted to the copying machine 1 by insertion in directions of arrow A in FIG. 1 at a position corresponding to a front lower right portion of the copying machine 1 as shown in FIG. 1. The sheet cassette 31 is a paper support means. Sheets of copy paper accommodated in the cassette 31 are fed one by one toward the imaging unit 20 by a feed roller 32.

The sheet transport unit 30 has a manual insertion tray 33 above the cassette 31. The manual insertion tray 33 is also the paper support means. By sliding a guide tray 331 in the directions of arrow B in FIG. 1 according to the size of copy paper for which an image is to be transferred, the copy paper is optimally set on the manual insertion tray 33. The sheet transport unit 30 further has a pair of feed rollers (upper and lower rollers) 34, 35 on a side of the imaging unit 20 facing the manual insertion tray 33 for feeding copy paper set on the manual insertion tray 33 toward the imaging unit 20.

The sheet transport unit 30 is further provided with a pair of transport rollers 36, 37 for transporting copy paper, fed from the cassette 31 or via the manual insertion tray 33, toward the imaging unit 20, and a pair of registration rollers 38, 39 for transporting the thus transported copy paper further toward the imaging unit 20 in synchronism with formation of a latent image.

With the above arrangement, the copy paper fed from the cassette 31 or via the manual insertion tray 33 is reliably transported to the imaging unit 20 by the feed roller 32, and rollers 34 to 39. After a latent image is transferred onto the copy paper in the imaging unit 20, the copy paper carrying the transferred image is transported toward the fixing unit 40.

The fixing unit 40 has a guide member 41. The copy paper subjected to image transfer in the imaging unit 20 is transported to a fixing roller pair 42 along the guide member 41 for image fixation. Upon completion of an image fixation by the fixing roller pair 42, the copy paper is discharged onto a discharge tray 50 mounted on a side of the copying machine 1 via a pair of discharge rollers 43, 44.

Figure 3:
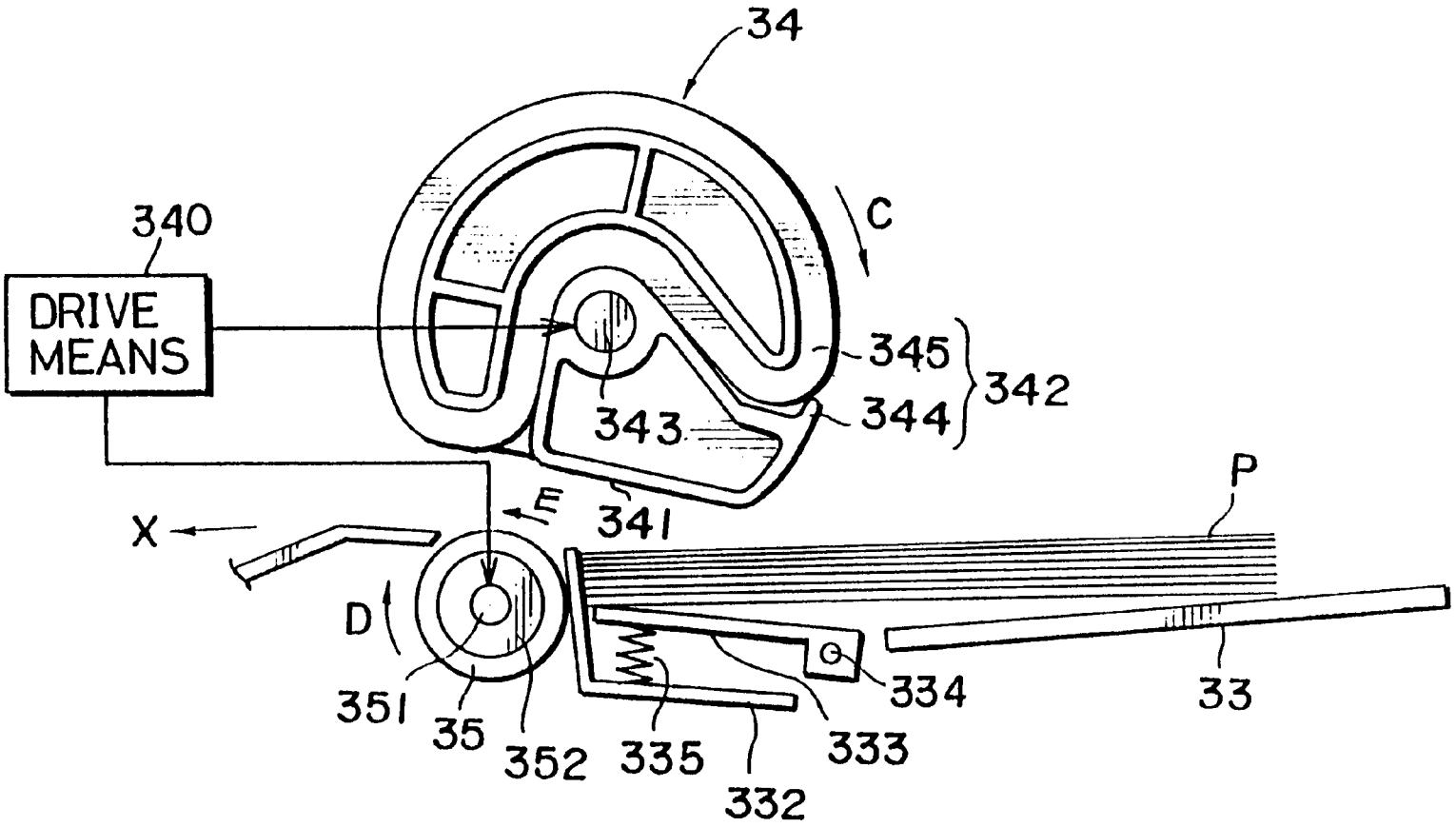
FIG. 3 is a side view of the paper feed mechanism.

Hereafter, the paper feed mechanism of this invention for use in the above-constructed copying machine 1 is described in detail referring to FIG. 3. The paper feed mechanism comprises the upper roller 34 and lower roller 35 and is described in combination with the arrangement of the manual insertion tray 33.

The manual insertion tray 33 has an L-shaped restriction plate 332 for restricting inadvertent motion of copy paper P toward the sheet transport direction, and a support plate 333 arranged above the restriction plate. The support plate 332 is pivotally rotatable about a pivot 334 arranged on the upstream side thereof with respect to the sheet transport direction to render the opposite side of the support plate 333 (downstream side) vertically pivotable. The support plate 333 is urged upward by a spring 335 arranged downstream below. With this arrangement, when a number of copy paper P are stacked on the manual insertion tray 33, a lead end of each copy paper P is reliably set on the support plate 333.

The upper roller (first roller) 34 has a non-contact area (flat portion) 341 and a contact area (round portion) 342 around an outer surface thereof. The non-contact area 341 is not brought into contact with the copy paper P or the lower roller (second roller) 35, whereas the contact area 342 comes into pressing contact with the copy paper P stacked on the manual insertion tray 33 and the lower roller 35. The upper roller 34 is rotatably mounted to a shaft 343 which is connected to drive means 340 comprising a motor and a gear mechanism. When a driving force is given to the shaft 343 by the drive means 340, the upper roller 34 is rotated in the direction of arrow C to feed the copy paper P in the sheet transport direction shown by the arrow X.

The contact area 342 has a first contact area (or pre-contact area) 344 formed at a lead end of the first roller 34 with respect to the rotational direction and a second contact area 345 following the first contact area. The frictional coefficient of the first contact area 344 relative to copy paper P is set smaller than that of the second contact area 345. Specifically, by setting the frictional coefficient of the first contact area 344 at a value smaller than that of the second contact area 345, the first contact area 344 slips over the surface of the copy paper P even though in contact with the paper P, thereby leaving the copy paper P on the manual insertion tray 33. Also, by setting the frictional coefficient of the second contact area 345 at a value high enough to frictionally move the copy paper P, the second contact area 345 of the first roller 34 can transport the copy paper P in the X-direction when in pressing contact with the copy paper P, utilizing the sufficient frictional force.

The first contact area 344 is provided to allow the lower roller 35 to reverse its rotational direction, thus following the rotation of the upper roller 34 and to desirably control a timing of feeding copy paper P from the manual insertion tray 33 so as to restrict feeding of the copy paper P until the rotational speed of the lower roller 35 is stabilized, after reversing the rotational direction thereof. More specifically, as mentioned above, during the time when the first contact area 344 comes into contact with the copy paper P, a frictional force is exerted between the first roller and the copy sheet is too small to feed the copy paper. That is, during this time, the copy paper P is not transported in the X-direction. The lower roller 35 has its rotational direction reversed to follow the rotation of the upper roller 34 during this time i.e. to rotate opposite in direction to the upper roller. In other words, the first contact area (pre-contact area) 344 is provided to allow the lower roller 35 to reverse its rotational direction and to stabilize the rotational speed until the copy paper P is ready to be transported in a steady state.

Considering the above, the length (distance) of the first contact area 344, in the rotational direction is set shorter than the length of the second contact area 345. Further, considering the fact that the second contact area 345 is adapted for transporting the copy paper P from the manual insertion tray 33 up to the transport roller pair 36, 37 arranged downstream with respect to the sheet transport direction, the length of the second contact area 345 is set to such a value as to forward at least the lead end of the copy paper P to the transport roller pair 36 37.

Figure 4:
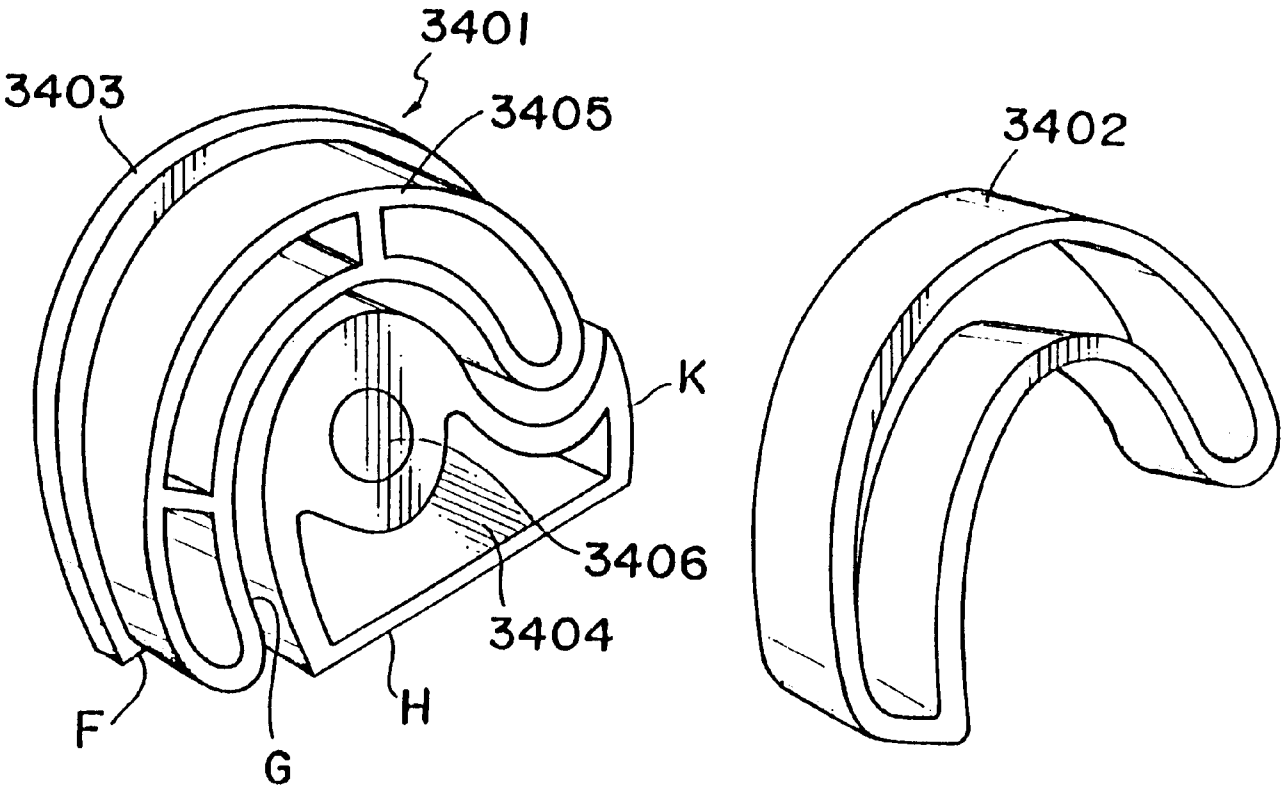
FIG. 4 is an exploded perspective view illustrating a construction of an upper roller constituting the paper feed mechanism.

The thus constructed upper roller 34 has, as shown in FIG. 4, a roller member 3401 formed of a resin and a rubber member 3402. The roller member 3401 has a D-shaped plate (base) 3403, a pre-contact portion 3404, and an arc-shaped contact portion (or support member) 3405. The base 3403 is obtained by cutting out a portion of a disc to make the whole contour into a D-shape with a flat portion F. The pre-contact portion 3404 has a shape like a scotch-tape holder and is arranged on the same side as the arc-shaped contact portion 3405 spaced away by a clearance G. The arc-shaped contact portion 3405 and the pre-contact portion 3404 each has a specified thickness in the axial direction of the roller.

The rubber member 3402 is mounted to the roller member 3401 by fitting the rubber member 3402 along an outer circumference of the support portion 3405. The pre-contact portion 3404 has a flat portion H corresponding to the flat portion F of the base 3403, and an arc portion K on the right side in FIG. 4. The roller member 3401 is formed with a through hole 3406 at the rotational center thereof to insert the shaft 343.

In the thus formed upper roller 34, the flat portion H of the pre-contact portion 3404 constitutes the non-contact area 341, the arc portion K constitutes the first contact area 344, and the outer circumference of the rubber member 3402 mounted on the support portion 3405 constitutes the second contact area 345.

Referring back to FIG. 3, the lower roller 35 is mounted to the shaft 351 via a torque limiter 352. When a driving force from the drive means 340 is transmitted to the shaft 351, the lower roller 35 is rotated together with the torque limiter 352 in the direction of arrow D to prevent the copy paper P from being transported to the X-direction. The torque limiter 352 has a well-known construction such that when a load beyond a predetermined value is exerted to a driven member (in this case, the lower roller 35), a coupling joint of the torque limiter 352 slips relative to the lower roller 35, thereby suspending transmission of the driving force of the shaft to the lower roller 35. In other words, when excessive force is applied to the outer surface of the second roller 35 in the radial direction of the second roller, then the rotation of the second roller in the direction is halted such that the torque limiter 352 is driven by the drive shaft 351, but the second roller 35 is not driven by the rotation of the torque limiter 352. Furthermore, when the excessive torque in the E-direction is applied to the outer surface of the second roller 35, then the second roller 35 is driven by the excessive force in the E-direction though the drive shaft 351 continues to apply the rotational torque in the D-direction.

With this arrangement, when not in pressing contact with the upper roller 34, the lower roller 35 is rotated in the D-direction, opposite to the sheet transport direction together with the torque limiter 352. On the contrary, when the lower roller 35 comes into pressing contact with the upper roller 34, the driving force of the shaft 351 is not transmitted to the lower roller 35 owing to an actuation of the clutch mechanism (torque limiter 352), and hence its lower roller 35 reverses the rotational direction to follow the rotation of the upper roller 34 and stabilizes its rotational speed during the contact with the pre-contact area 344 preparation for steady rotation together with the upper roller 34.

In this embodiment, the shaft 343 of the upper roller 34 and the shaft 351 of the lower roller 35 are driven by the common drive means 340. Instead of this arrangement, the shafts 343 and 351 may be driven by drive means individually provided for the shafts.

The thus constructed paper feed mechanism feeds copy paper P stacked on the manual insertion tray 33 in the following manner.

Before a copy start switch (not shown) of the copying machine 1 is operated, the upper roller 34 is set to the state shown in FIG. 3 where the non-contact area 341 faces down, i.e., the upper roller 34 is set to a non-contact state with the copy paper P. When the copy start switch is operated, the upper roller 34 starts to rotate in the C-direction to feed the uppermost copy paper P along the sheet transport direction X, while the lower roller 35 rotates in the D-direction to prevent an inadvertent feed of copy paper in the X-direction.

Figure 5:
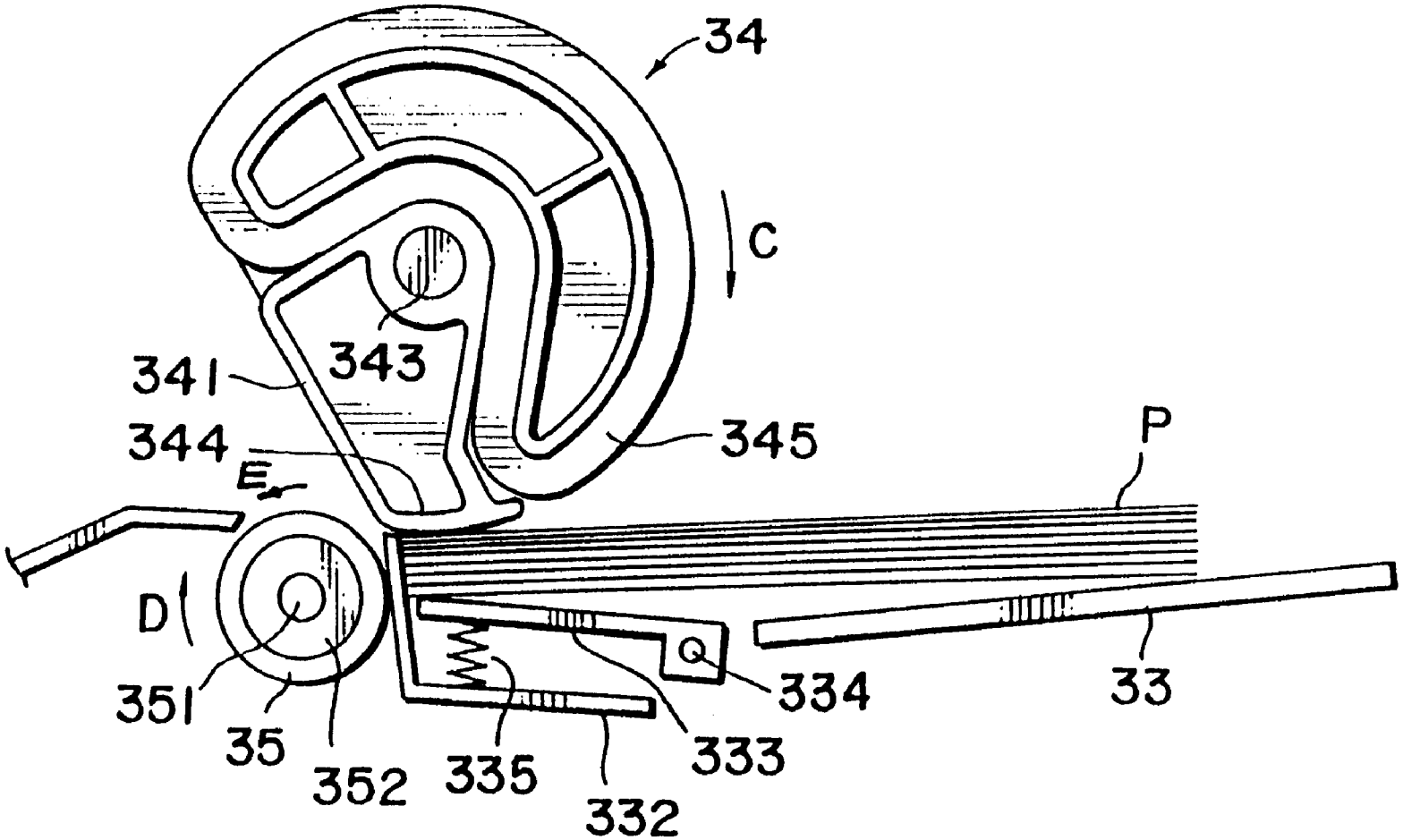
FIG. 5 is a side view illustrating an operation of the paper feed mechanism in a state that the upper roller starts its rotation.

Then, as the rotation of the upper roller 34 is proceeds, the first contact area (pre-contact area) 344 comes into contact with the upper surface of the copy paper P, as shown in FIG. 5. However, since the frictional coefficient of the first contact area 344 relative to the copy paper P is set small, the first contact area 344 merely slips over the surface of the copy paper P, thus maintaining the copy paper P in a stationary state on the manual insertion tray 33.

Figure 6:
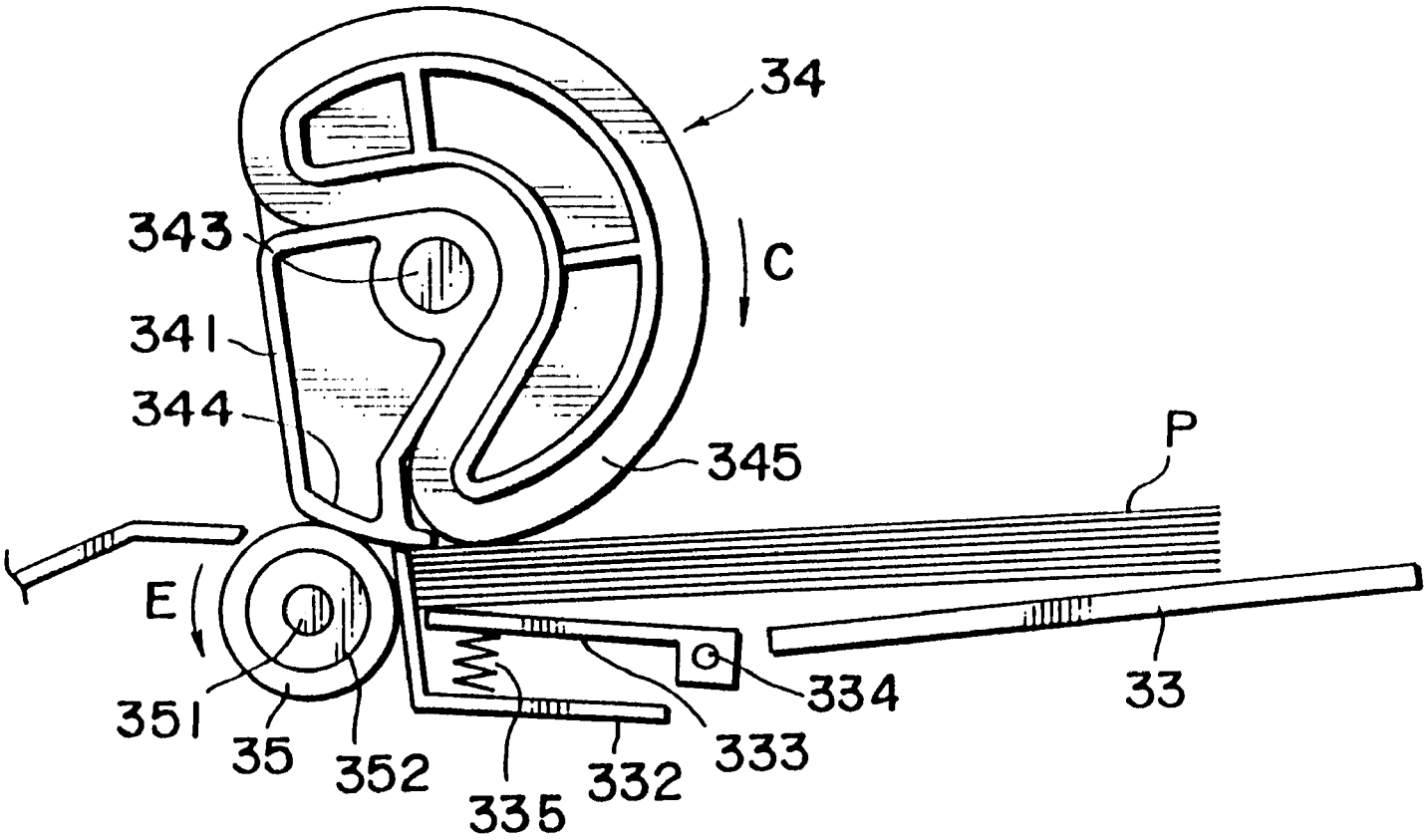
FIG. 6 is a side view illustrating an operation of the paper feed mechanism in a state that rotation of the upper roller proceeds.

Referring to FIG. 6, as the rotation of the upper roller 34 is further carried on, the second contact area 345 comes into pressing contact with the upper surface of the copy paper P. Since the frictional coefficient of the second contact area 345 is set large enough to cause frictional force against the copy paper P, the copy paper P is sufficient to move the copy paper P is fed in the X-direction, by the frictional force. At this time, the first contact area 344 departs from the copy paper P and comes into pressing contact with the lower roller 35. Then, the lower roller 35 starts to be driven in the direction of arrow E (sheet transport direction) following the rotation of the upper roller 34 in the C-direction by an actuation of the torque limiter 352. Specifically, during the pressing contact with the first contact area 344 of the upper roller 34, the lower roller 35 reverses the rotational direction from the D-direction to the E-direction and stabilizes the rotational speed in its following manner.

Immediately after its lower roller 35 reverses the rotational direction, the rotational speed of the lower roller 34 in the E-direction is not stabilized. Accordingly, the first contact area 344 is provided as a pre-contact area prior to the second contact area 345 so that a lead end of the copy paper P does not reach the nip position between the first and second rollers 34, 35 immediately after the lower roller 35 changes rotational direction. It should be appreciated that the rotational speed of the lower roller 35 in the E-direction is gradually stabilized as time lapses (i.e., the second contact area 345 approaches the lower roller 35).

Figure 7:
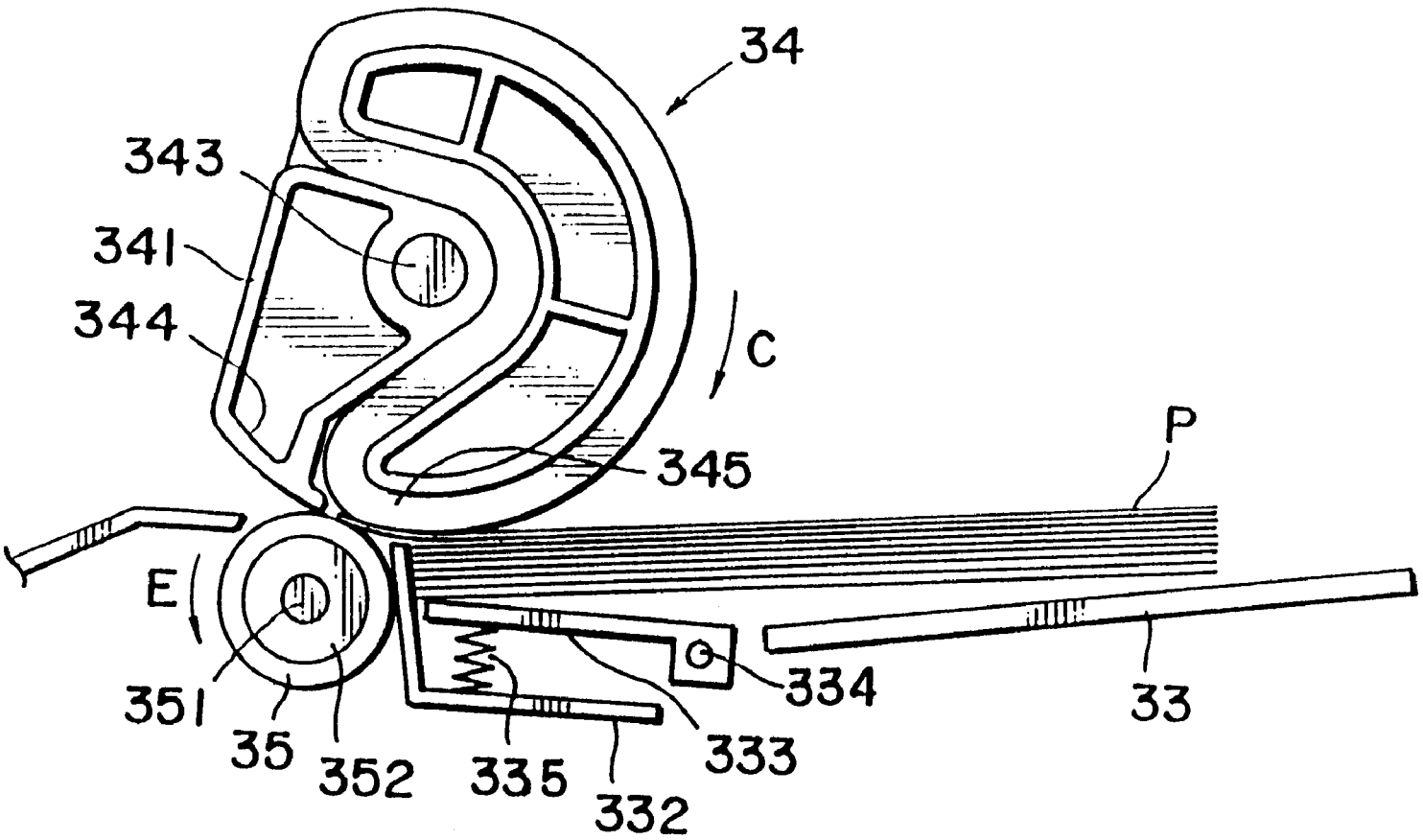
FIG. 7 is a side view illustrating an operation of the paper feed mechanism in a state that the rotation of the upper roller further proceeds from that of FIG. 6.

Referring to FIG. 7, as the rotation of the upper roller 34 further proceeds from that shown in FIG. 6, a lead end of the second contact area 345 comes into pressing contact with the lower roller 35 with copy paper P nipped therebetween. By this time, the rotational speed of the lower roller 35 is stabilized following the rotation of the upper roller 34. Accordingly, the upper roller 34 is constructed such that the lead end of the copy paper P reaches the nip position between the upper and lower rollers 34, 35 when the second contact area 345 comes into pressing contact with the copy paper P.

Note that the frictional coefficient of the lower roller 35 relative to copy paper P is set larger than a frictional coefficient between the copy paper P. Accordingly, the provision of lower roller 35 prevents multifeed of copy paper.

Upon reaching the nip position between the upper and lower rollers 34 and 35, the copy paper P is fed downstream. When the upper roller 34 rotates by one turn, feed of the copy paper P by the upper and lower rollers 34 and 35 toward the downstream is completed.

Thus, the paper feed mechanism of this invention is constructed such that copy paper P is nipped between the upper and lower rollers 34, 35 after its lower roller 35 reverses the rotational direction and stabilizes its rotational speed. Accordingly, feed of copy paper is stabilized to effect a precise timing of feeding copy paper P toward the downstream arranged rollers such as transport rollers 36, 37.

In the case where a number of copy paper P stacked on the manual insertion tray 33 are to be sequentially fed by the paper feed mechanism, the upper roller 34 rotates by the number identical to the number of copy paper P.

In this embodiment, the second contact area 345 of the upper roller 34 is formed of a rubber member. However, the second contact area 345 may be formed by forming an undulation on a surface of a resin.

In this embodiment, the upper roller 34 is constructed such that copy paper is nipped between the upper and lower rollers 34, 35 after rotation of the lower roller 35 in the E-direction is completely stabilized, i.e., reaches a constant speed. Alternatively, transport of copy paper may be initiated even if the rotational speed of the lower roller 35 is not yet in a completely steady state, as far as it is confirmed that a certain time is elapsed upon reversing of the rotational direction of the lower roller 35. In this case, also, copy paper can be assuredly fed toward the transport rollers 36, 37 located downstream in the sheet transport direction at a desired timing.

In the foregoing embodiment, the paper feed mechanism of this invention is described in combination with the manual insertion tray 33, but may also be applicable in combination with the paper cassette 31.

As described in the above embodiment, the paper feed mechanism of this invention comprises an upper roller and a lower roller and that the upper roller has a non-contact area, first contact area and second contact area around an outer surface thereof in this order with respect to the rotational direction. The lower roller is mounted on a torque limiter. When not in pressing contact with the upper roller, the lower roller rotates in a direction opposite to the sheet transport direction, but while in pressing contact with the first contact area or the second contact area, the lower roller rotates in the sheet transport direction following the rotation of the upper roller by an actuation of the torque limiter.

Further, the frictional coefficient of the first contact area relative to copy paper is set smaller than that between the copy paper, and the frictional coefficient of the second contact area relative to the copy paper is set greater than that between the copy paper. Accordingly, feed of copy paper can be stabilized to transport the copy paper along the sheet transport direction with a desired timing.

In the aforementioned embodiment, the first contact area is provided to allow the copy paper to reach the nip position between the upper and lower rollers after confirming that the rotational speed of the lower roller is stabilized. This is to prevent the copy paper from being fed from the paper support means during an unsteady state of the lower roller which changes its rotational direction to follow the rotation of the upper roller. Accordingly, the copy paper can be accurately fed downstream with a desired timing from the paper support means.

In the above embodiment, further, the first contact area is made of a resin, and the second contact area is made of a rubber material. Accordingly, the second contact area, when in pressing contact with copy paper can assuredly feed out the copy paper from the paper support means, but the first contact area (pre-contact area) leaves the copy paper on the paper support means without inadvertent feed of copy paper in the sheet transport direction.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A paper feed mechanism in which copy paper is stacked on paper support means for supporting paper and fed therefrom in a sheet transport direction, the paper feed mechanism comprising:

a first roller for feeding a copy paper sheet from the copy paper stacked on the paper support means in the sheet transport direction;

a second roller for feeding the copy paper sheet in the sheet transport direction by nipping the copy paper sheet between the first roller and the second roller;

a torque limiter connected to the second roller for driving the second roller;

drive means for rotating the first roller in a first rotational direction for feeding the copy sheet paper in the sheet transport direction and for rotating the second roller in said first rotational direction for urging the copy sheet in a direction opposite to the sheet transport direction via the torque limiter;

the first roller including a non-contact area and a contact area following the non-contact area around an outer surface thereof;

the contact area having a first contact area and a second contact area following the first contact area, the first contact area coming into pressing contact first with the copy paper sheet and second with the second roller as said drive means rotates the first roller in the first rotational direction;

the first contact area having a first area coefficient of friction with respect to the copy paper sheet permitting slipping of the first contact area over a surface of the copy paper sheet without feeding the copy paper sheet from the paper support means; and the second contact area coming into pressing contact with the copy paper sheet after the first contact area slides over the copy paper sheet to engage the copy paper sheet in conjunction with the second roller to feed the copy paper sheet from the paper support means in the sheet transport direction by a frictional force exerted on the copy paper sheet.

2. The paper feed mechanism according to claim 1, wherein the second roller rotates in the first rotational direction when not in pressing contact with the first roller and reverses rotational direction to a second rotational direction when in pressing contact with the first roller by operation of the torque limiter to feed the copy paper sheet in the sheet transport direction when nipped between the first roller and the second roller.

3. The paper feed mechanism according to claim 1, wherein:

the first area coefficient of friction of the first contact area is sufficient to drive the second roller in a second rotational direction for feeding the copy paper sheet in the sheet feeding direction when in pressing contact with the second roller; and the second contact area has a second area coefficient of friction sufficient to feed the copy paper sheet and drive the second roller to feed the copy paper sheet in the sheet feeding direction when in pressing contact with the copy paper sheet and the second roller respectively.

4. The paper feed mechanism according to claim 1, wherein the first area coefficient of friction and the pressing contact with the second roller of the first contact area is adapted for reversing direction of rotation of the second roller to a second rotational direction and stabilizing a rotational speed of the second roller in the second rotational direction to control a timing of feeding of the copy paper sheet from the paper support means such that the copy paper sheet is nipped between the first roller and the second roller after the rotational speed of the second roller is stabilized.

5. The paper feed mechanism according to claim 1, wherein the first area coefficient of friction of the first contact area relative to the copy paper sheet is smaller than a coefficient of friction of the second contact area relative to the copy paper sheet.

6. The paper feed mechanism according to claim 1, wherein the first contact area is made of a resin, and the second contact area has a surface of elastic material covering a surface of a resin.

7. A paper feed mechanism in which copy paper is stacked on paper support means for supporting sheets and fed therefrom in a sheet transport direction, the paper feed mechanism comprising:

a first roller for feeding a copy paper sheet from the copy paper stacked on the paper support means in the sheet transport direction;

a second roller for feeding the copy paper sheet in the sheet transport direction by nipping the copy paper sheet between the first roller and the second roller;

a torque limiter connected to the second roller for driving the second roller up to a predetermined torque limit;

drive means for rotating the first roller in a first rotational direction for feeding the copy sheet paper in the sheet transport direction and for rotating the second roller in said first rotational direction for urging the copy sheet in a direction opposite to the sheet transport direction via the torque limiter when torque applied to a circumferential surface of the second roller is less than the predetermined torque;

the first roller including a non-contact area and a contact area following the non-contact area around an outer surface thereof;

the contact area having a first contact area and a second contact area following the first contact area, the first contact area coming into pressing contact first with the copy paper sheet and second with the second roller as said drive means rotates the first roller in the first rotational direction;

the first contact area having a first area coefficient of friction with respect to the copy paper sheet permitting slipping of the first contact area over a surface of the copy paper sheet and with respect to the circumferential surface of the second roller sufficient to produce torque exceeding the predetermined torque; and the second contact area coming into pressing contact with the copy paper sheet after the first contact area slides over the copy paper sheet to engage the copy paper sheet in conjunction with the second roller to feed the copy paper sheet from the paper support means in the sheet transport direction by a frictional force exerted on the copy paper sheet.

8. The paper feed mechanism according to claim 7, wherein the second roller rotates in the first rotational direction when not in pressing contact with the first roller and reverses rotational direction to a second rotational direction when in pressing contact with the first roller by operation of the torque limiter to feed the copy paper sheet in the sheet transport direction when nipped between the first roller and the second roller.

9. The paper feed mechanism according to claim 7, wherein:

the first area coefficient of friction of the first contact area is sufficient to drive the second roller in a second rotational direction for feeding the copy paper sheet in the sheet feeding direction when in pressing contact with the second roller; and the second contact area has a second area coefficient of friction sufficient to feed the copy paper sheet and drive the second roller to feed the copy paper sheet in the sheet feeding direction when in pressing contact with the copy paper sheet and the second roller respectively.

10. The paper feed mechanism according to claim 7, wherein the first area coefficient of friction and the pressing contact with the second roller of the first contact area is adapted for the reversing direction of rotation of the second roller to a second rotational direction and stabilizing a rotational speed of the second roller in the second rotational direction to control a timing of feeding of the copy paper sheet from the paper support means such that the copy paper sheet is nipped between the first roller and the second roller after the rotational speed of the second roller is stabilized.

11. The paper feed mechanism according to claim 7, wherein the first area coefficient of friction of the first contact area relative to the copy paper sheet is smaller than a coefficient of friction of the second contact area relative to the copy paper sheet.

12. The paper feed mechanism according to claim 7, wherein the first contact area is made of a resin, and the second contact area has a surface of elastic material covering a surface of a resin.

13. A method of feeding copy paper stacked on paper support means for supporting paper in a sheet transport direction comprising the steps of providing a paper feed mechanism having:

a first roller for feeding a copy paper sheet from the copy paper stacked on the paper support means in the sheet transport direction;

a second roller for feeding the copy paper sheet in the sheet transport direction by nipping the copy paper sheet between the first roller and the second roller;

a torque limiter connected to the second roller for driving the second roller up to a predetermined torque limit;

drive means for rotating the first roller in a first rotational direction for feeding the copy sheet paper in the sheet transport direction and for rotating the second roller in said first rotational direction for urging the copy sheet in a direction opposite to the sheet transport direction via the torque limiter when torque applied to a circumferential surface of the second roller is less than the predetermined torque;

the first roller including a non-contact area and a contact area following the non-contact area around an outer surface thereof;

the contact area having a first contact area and a second contact area following the first contact area, the first contact area coming into pressing contact first with the copy paper sheet and second with the second roller as said drive means rotates the first roller in the first rotational direction; and the first contact area having a first area coefficient of friction with respect to the copy paper sheet permitting slipping of the first contact area over a surface of the copy paper sheet and with respect to the circumferential surface of the second roller sufficient to produce torque exceeding the predetermined torque;

operating the drive means to drive the torque limiter to rotate the second roller in the first rotational direction corresponding to urging the copy sheet in a direction opposite to the sheet transport direction;

operating the drive means, while the drive means is rotating the second roller in the first rotational direction via the torque limiter, to rotate the first roller in the first rotational direction to bring the first contact area of the first roller into such pressing contact with the copy paper so as to slip over the copy paper sheet;

further operating the drive means, while the drive means is rotating the second roller in the first rotational direction via the torque limiter, to rotate the first roller in the first rotational direction to bring the first contact area of the first roller into such pressing contact with the second roller so as to produce a torque on the second roller exceeding the predetermined torque such that the second roller reverses its rotational direction to a second rotational direction and stabilizes rotational speed during contact with the first contact area; and operating the drive means to rotate the first roller to bring the second contact area of the first roller into pressing contact with the copy paper sheet stacked on the paper support means to transport the copy paper sheet in the sheet transport direction, while the rotational speed of the second roller stabilizes, and place the copy paper sheet in nipped engagement with the first roller and the second roller when the rotational speed of the second roller is stabilized to effect further transport of the copy paper sheet in the sheet transport direction.

14. A paper feed mechanism in which copy paper is stacked on paper support means for supporting paper and fed therefrom in a sheet transport direction, the paper feed mechanism comprising:

a first roller for feeding a copy paper sheet from the copy paper stacked on the paper support means in the sheet transport direction;

a second roller for feeding the copy paper sheet in the sheet transport direction by nipping the copy paper sheet between the first roller and the second roller;

a torque limiter connected to the second roller for driving the second roller up to a predetermined torque limit;

drive means for rotating the first roller in a first rotational direction for feeding the copy sheet paper in the sheet transport direction and for rotating the second roller in said first rotational direction for urging the copy sheet in a direction opposite to the sheet transport direction via the torque limiter when torque applied to a circumferential surface of the second roller is less than the predetermined torque;

the first roller including a non-contact area and a contact area following the non-contact area around an outer surface thereof;

the contact area having a first contact area and a second contact area following the first contact area, the first contact area coming into pressing contact first with the copy paper sheet and second with the second roller as said drive means rotates the first roller in the first rotational direction;

the first contact area having a first area coefficient of friction with respect to the copy paper sheet permitting slipping of the first contact area over a surface of the copy paper sheet and with respect to the circumferential surface of the second roller sufficient to produce torque exceeding the predetermined torque;

the second contact area having a second area coefficient of friction sufficient to feed the copy paper sheet and drive the second roller to feed the copy paper sheet in the sheet feeding direction when in pressing contact with the copy paper sheet and the second roller respectively;

the second contact area coming into pressing contact with the copy paper sheet after the first contact area slides over the copy paper sheet to engage the copy paper sheet in conjunction with the second roller to feed the copy paper sheet from the paper support means in the sheet transport direction by a frictional force exerted on the copy paper sheet; and the first area coefficient of friction and the pressing contact with the second roller of the first contact area being sufficient for a reversing direction of rotation of the second roller to a second rotational direction and stabilizing a rotational speed of the second roller in the second rotational direction prior to the copy paper sheet being nipped between the first roller and the second roller.

* * * * *